US005167517A

United States Patent [19]

Long

[11] Patent Number: 5,167,517

[45] Date of Patent: Dec. 1, 1992

[54] EJECTING SIMM SOCKET

[76] Inventor: Frank T. Long, 1351 Rambling Rd., Simi Valley, Calif. 93065

[21] Appl. No.: 803,152

[22] Filed: Dec. 5, 1991

[51] Int. Cl.[5] ..... H01R 13/62

[52] U.S. Cl. ..... 439/160

[58] Field of Search ..... 439/152-157, 439/159, 160

[56] References Cited

U.S. PATENT DOCUMENTS 4,801,272 1/1989 Kanazawa et al. ..... 439/153

4,898,540 2/1990 Saito ..... 439/153

*Primary Examiner*—Joseph H. McGlynn

*Attorney, Agent, or Firm*—Timothy T. Tyson

[57] ABSTRACT

A socket (60) is provided that receives a single in-line memory module (SIMM) and facilitates the ejection of the SIMM from the socket through the use of a pair of latches (62, 64) rotatably mounted in a base (66). The latches each define a resilient flap (72) carrying a boss (74) to be received in a hole (50) in the SIMM for retention of the SIMM. One of the latches also defines an ear (110) to be received in a notch (112) of the SIMM for proper orientation of the SIMM within the socket.

20 Claims, 5 Drawing Sheets 20
22
24
26
28
30
32
34
40
42
44
46
50
52
1D

EJECTING SIMM SOCKET

TECHNICAL FIELD

The present invention pertains to sockets for receiving single in-line memory modules (SIMM) and, more particularly, to sockets facilitating the ejection of the SIMM.

BACKGROUND ART

A single in-line memory module (SIMM) is a circuit board having all the logic chips needed to add random access memory (RAM) to a computer. Sockets configured to receive a SIMM are well known in the art but typically are not configured to facilitate ejection of the SIMM. A typical socket is described in the following Modes for Carrying Out the Invention.

DISCLOSURE OF INVENTION

The present invention is directed to a socket for receiving a single in-line memory module (SIMM) and facilitating ejection of the SIMM from the socket.

Apparatus in accordance with the invention are characterized by latches rotatably mounted in a base. The latches are each configured with a slot to receive a corner of the contact edge of the SIMM whereby rotation of the latches applies force to the edge via the slot and the SIMM is thereby ejected from the socket.

In accordance with a feature of the invention, each latch defines a resilient flap bearing a boss which is received in a hole on the edge of the SIMM to facilitate retention of the SIMM in the socket.

In accordance with another feature of the invention, one of the latches defines an ear which is received in a notch in the side edge of the SIMM to facilitate orientation of the SIMM in the socket.

The novel features of the invention are set forth with particularity in the appended claims. The invention will be best understood from the following description when read in conjunction with the accompanying drawings.

MODES FOR CARRYING OUT THE INVENTION

A single in-line memory module (SIMM) is a circuit board containing all the logic chips needed to add random access memory (RAM) to a computer. SIMM's are well known in the art and are typically mounted in a socket similar to the prior art socket 20 illustrated, with a SIMM 22, in FIG. 1A–1C which are, respectively, front elevation, partial top plan and partial bottom plan views and in FIG. 1D which is a view along the plane 1D—1D of FIG. 1B.

Figures 1A, 1B, 1C, 1D, 1E, 1F:
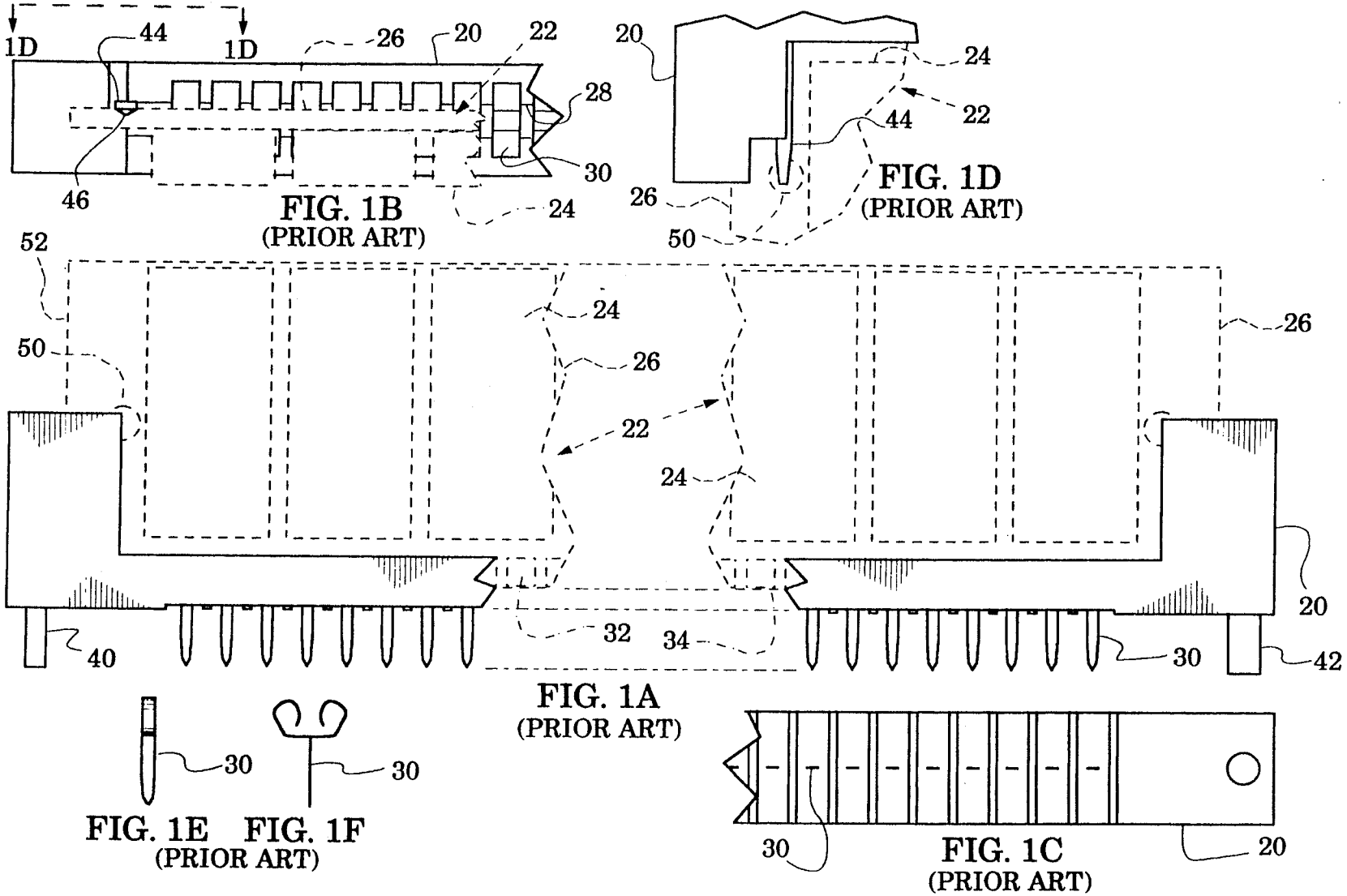
FIG. 1D (PRIOR ART)
FIG. 1B (PRIOR ART)
FIG. 1A (PRIOR ART)
FIG. 1C (PRIOR ART)
FIG. 1F (PRIOR ART)
FIG. 1A is a side elevation view of a single in-line memory module (SIMM) installed in a prior art socket.
FIG. 1B is a partial top plan view of the socket of FIG. 1A.
FIG. 1C is a partial bottom plan view of the socket of FIG. 1A.
FIG. 1D is a view along the plane 1D—1D of FIG. 1A.
FIG. 1E is a side elevation view of a contact pin of the socket of FIG. 1A.
FIG. 1F is a front elevation view of the contact pin of FIG. 1E.

A common configuration of a SIMM has nine logic chips 24 mounted by surface mount technology to the SIMM circuit board 26 (i.e. the chips are soldered to contacts on the surface of the board 26 rather than in through holes therein). A typical socket 20 has a slot 28 to receive the SIMM 22. Contact pins 30, shown in the side elevation and front elevation views of FIGS. 1E and 1F, are arranged, through holes in the socket base, in a single row along the slot 28 for electrical connection to contacts 32 on both sides of the contact edge 34 of the circuit board 26. Each contact pin 30 abuts a pair of contacts 32 located on opposite sides of the circuit board 26.

The socket 20 has a pair of posts 40, 42 which are used to insure correct orientation of the socket 20 when it is installed in a receiving structure. For this purpose the post 42 is larger in diameter than the post 40.

The socket 20 typically defines, at each end, a resilient tab 44 which has a projection 46 that is received in a hole 50 located along a side edge 52 of the SIMM. This facilitates retention of the SIMM 22 in the socket 20. The SIMM 22 is installed in the socket 20 by pressing it into the slot 28 until the projection 46 snaps into the hole 50. The SIMM 22 is removed by pulling upwards with sufficient force to overcome the friction of the projection 46 in the hole 50 and the contact edge 34 in the contact pins 30. The presence of the logic chips 24 and the fact that SIMM's are often installed in close proximity to other SIMM's restricts the area available for a user's hands to grasp the SIMM 22 and makes this removal process quite difficult.

Although not shown in FIGS. 1A-1D, the socket 20 typically has, on one side, an ear that is received in a notch in the SIMM board 26. This ear insures the correct orientation of the SIMM 22 in the socket 20.

Figure 2:
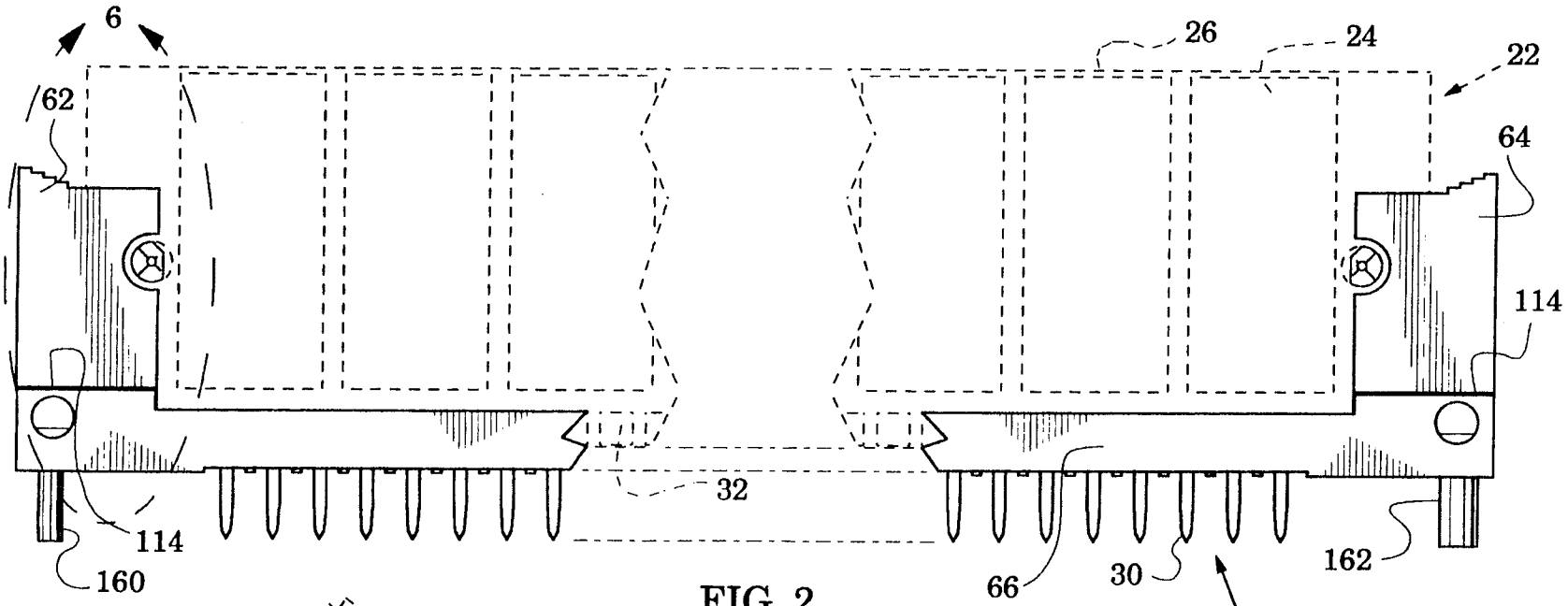
FIG. 2 is a side elevation view of a SIMM installed in an ejecting socket embodiment in accordance with the present invention.
Figure 6:
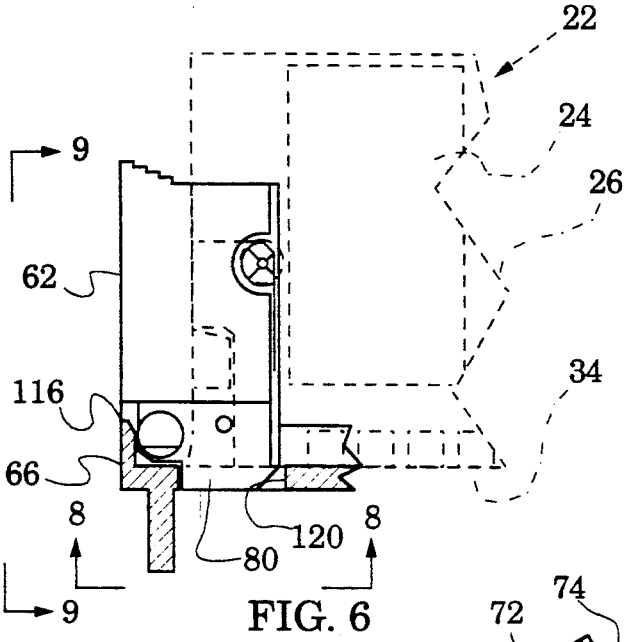
FIG. 6 is a partially sectioned view of the area within the line 6—6 of FIG. 2.
Figure 7:
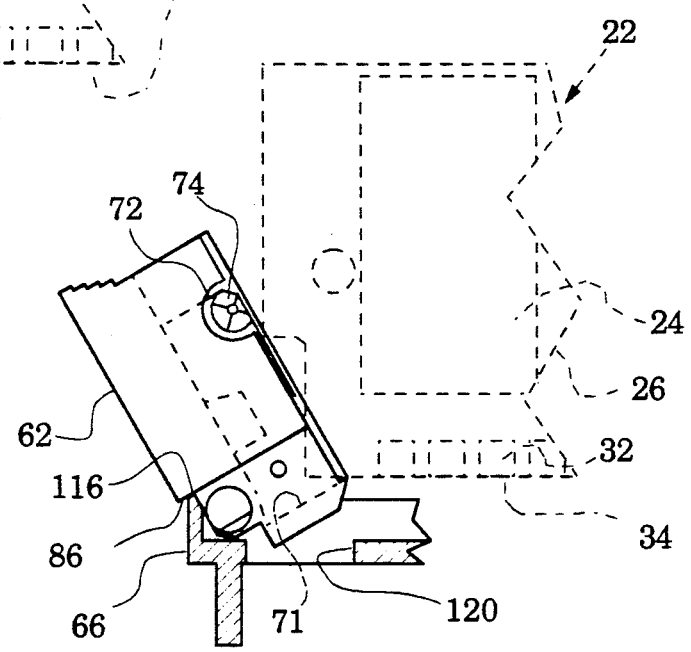
FIG. 7 is a view similar to FIG. 6 illustrating the latch of FIG. 6 in an open position.

FIG. 2 is a front elevation view of a preferred ejecting socket embodiment 60 in accordance with the present invention, FIG. 6 is a view of the area within the line 6 of FIG. 2 and FIG. 7 is a view similar to FIG. 6. In contrast with the socket 20 of FIGS. 1A-1D, FIGS. 2, 6 and 7 illustrate the use of a pair of latches 62, 64 which are rotatably mounted in an elongated base 66 for receiving and ejecting a SIMM 22. The SIMM 22 is shown received in the latches 62, 64 in FIG. 2 and in the latch 62 in FIG. 6 while in FIG. 7 the latch 62 has been rotated to eject the SIMM 22 (the SIMM is shown with the same designation numbers used in FIGS. 1A-1F above). Thus the latches 62, 64 allow a user of the ejecting socket 60 to easily remove the SIMM 22 therefrom.

Figures 10A, 10B, 10C, 10D:
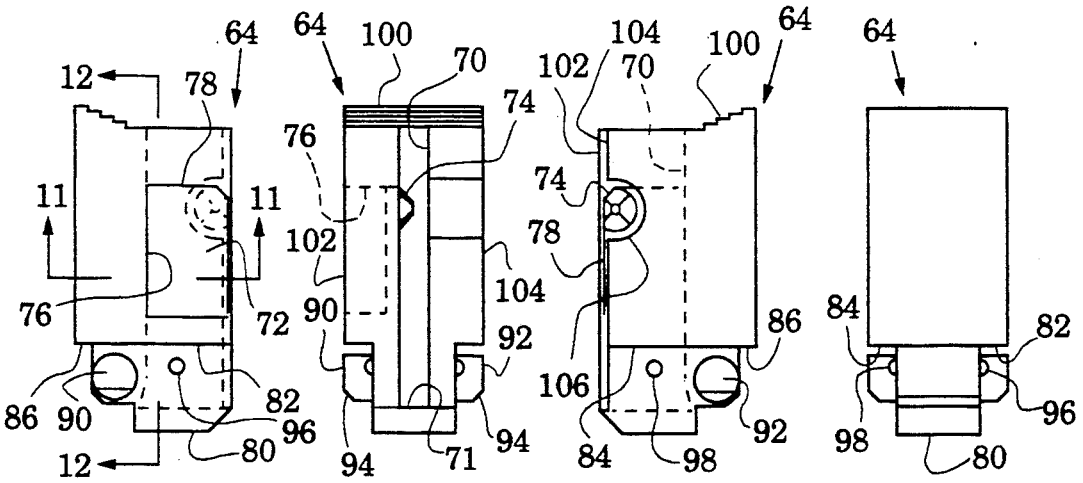
FIG. 10A is a side elevation view of the latch on the right side of FIG. 2.
FIG. 10B is a front elevation view of the latch of FIG. 10A.
FIG. 10C is another side elevation view of the latch of FIG. 10A.
FIG. 10D is a rear elevation view of the latch of FIG. 10A.
Figure 11:
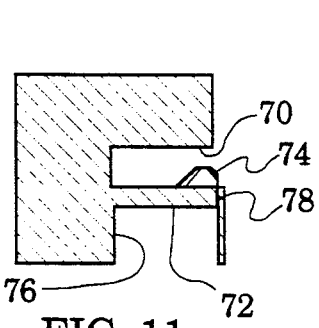
FIG. 11 is a view along the plane 11—11 of FIG. 10A.
Figure 12:
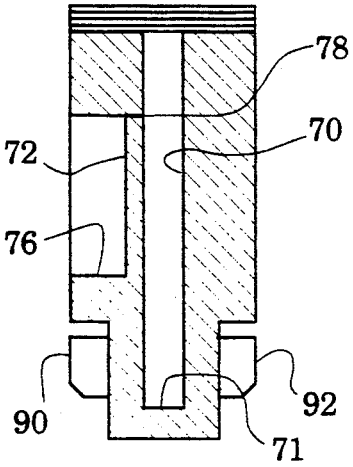
FIG. 12 is a view along the plane 12—12 of FIG. 10A.

Before further description of the operation of the latches 62, 64 in the base 66, it will be helpful to gain a more detailed understanding of the latches 62, 64 through FIGS. 10A-10D, 11, 12 and 13A-13C. In FIGS. 10A-10D the latch 64 is shown in, respectively, side elevation, front elevation, side elevation and rear elevation views. FIG. 11 is an enlarged view along the plane 11-11 of FIG. 10A and FIG. 12 is an enlarged view along the plane 12—12 of FIG. 10A. In these figures the latch 64 is seen to define a slot 70 terminating in a floor 71, the slot 70 configured to receive a corner of the contact edge (34 in FIGS. 6, 7) of the SIMM. The latch 64 further defines a resilient flap 72 carrying, in a corner of the flap, a boss 74. The flap 72 is formed by the recess 76 and an L shaped cut 78 along two sides of the recess 76 as is best seen in FIGS. 11 and 12.

A tongue 80 descends from the bottom of the latch 64 and its juncture with the body of the latch defines, on either side, steps 82, 84 and, at the rear, a lip 86. On the sides of the tongue 80, the latch 64 defines a pair of shafts 90, 92, each having a bevel 94, and a pair of knobs 96, 98. At its top, the latch 64 defines serrations 100.

The slot 70 is defined by the sides 102, 104. The side 104 is shorter than the side 102 assuring that it will clear the logic chips (24 in FIG. 2) on the face of the SIMM (22 in FIG. 2). The side 104 also has an indentation 106 to facilitate forming the boss 74 if the latch 64 is molded from a plastic material.

Figures 13A, 13B, 13C:
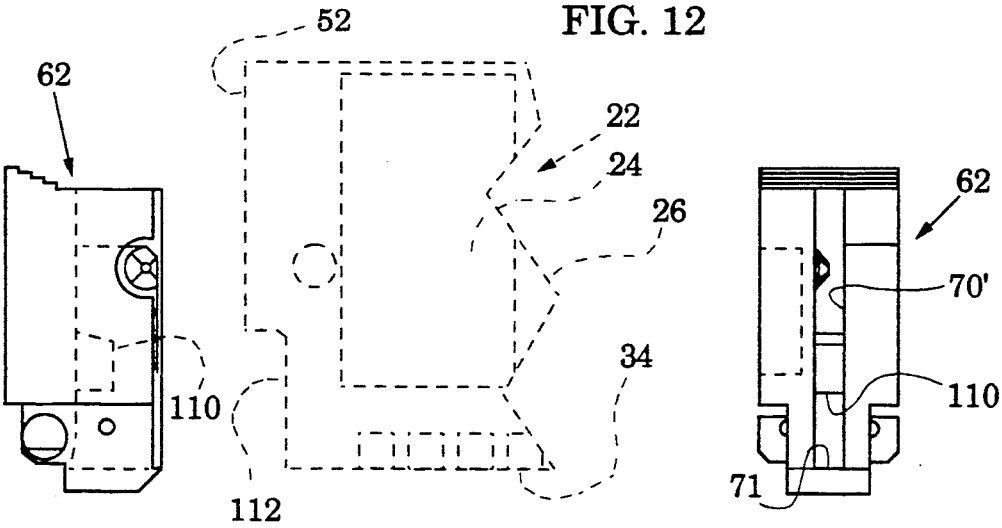
FIG. 13A is a side elevation view of the latch of FIG. 6.
FIG. 13B is a partial side elevation view of a SIMM illustrating its correspondence with the latch of FIG. 13A.
FIG. 13C is a front elevation view of the latch of FIG. 13A.
Figures 14A, 14B, 14C, 14D:
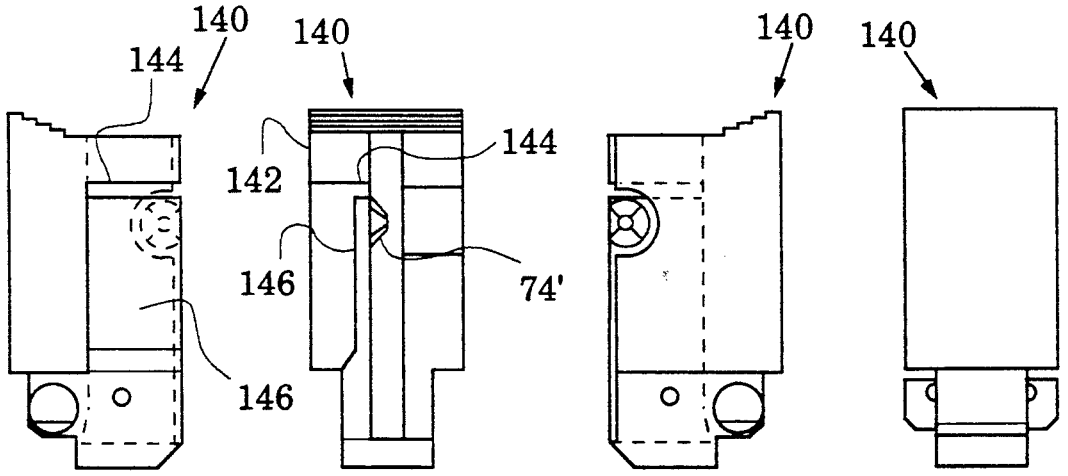
FIG. 14A is a view similar to FIG. 10A illustrating another latch embodiment in accordance with the present invention.
FIG. 14B is a front elevation view of the latch of FIG. 14A.
FIG. 14C is another side elevation view of the latch of FIG. 14A.
FIG. 14D is a rear elevation view of the latch of FIG. 14A.

The latch 62 is illustrated in the side elevation view of FIG. 13A and the front elevation view of FIG. 13C. The latch 62 differs from the latch 64 only in the addition of an ear 110 within the slot 70'. FIG. 13B shows a portion of the SIMM 22 in proximity to the latch 62 of FIG. 13A to illustrate that the ear 110 may be received in a notch 112 in the side edge 52 of the SIMM 22. The ear 110 and the longer side 102 of the slot 70 working in conjunction with, respectively, the notch 112 and positioning of the chips 224 on one side of the SIMM 22 insure that the SIMM can be physically inserted only one way in the socket 60 thereby assuring that the SIMM is appropriately electrically oriented in the socket.

Returning to FIGS. 2 and 6 through 9 it is seen that the base 66 terminates along each side in a margin 114 and is reduced in the back where it terminates in an edge 116. The closed position of the latch 62 shown in FIG. 6 is defined when the steps 82, 84 abut the margins 114 and the open position shown in FIG. 7 is defined when the edge 116 is received by the lip 86. The SIMM 22 may be inserted into the socket 60 by placing it within the latch 62 (and latch 64) as shown in FIG. 7 and then pressing down to swing the latches inboard. The resilient flap 72 allows the boss 74 to pass over the face of the SIMM until it returns to its normal position in the SIMM hole 50, as shown in FIG. 6, to retain the SIMM 22 in the socket 60.

Alternatively, the latches 62, 64 may be left in the closed position as shown in FIG. 6 and the SIMM 22 pressed downward causing the boss 74 to be received in the hole 50. In either case the SIMM 22 is ejected by rotating the latch 62 (and the latch 64) to the open position of FIG. 7, the rotation causing the slot floor 71 to abut the SIMM contact edge 34 which lifts the SIMM 22 from the base 66. It may be seen in FIGS. 10A, C that the slot 70 is tapered inward as it terminates in the tongue 80. This insures that the slot 70 clears the SIMM 22 as it is ejected as shown in FIG. 7.

Figure 8:
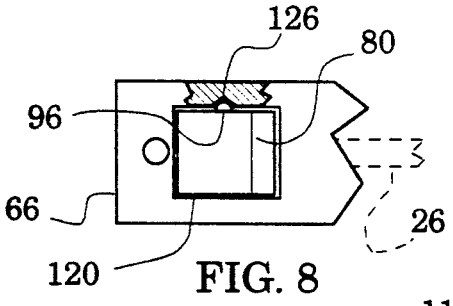
FIG. 8 is a view along the plane 8—8 of FIG. 6.
Figure 9:
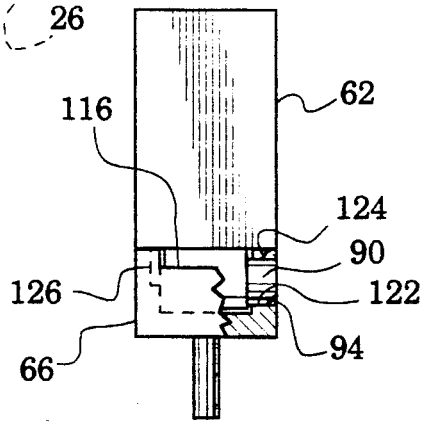
FIG. 9 is a view along the plane 9—9 of FIG. 6.

FIG. 8 is a view along the plane 8—8 of FIG. 6 illustrating that the base 66 defines an opening 120 to receive the tongue 80 of the latch 62 when it is in the closed position of FIG. 6. FIG. 9 is a view along the plane 9—9 of FIG. 6 showing the shaft 90 received in a hole 122 in the base 66. The base 66 defines a ramp 124 above the hole 122 which cooperates with the bevel 94 on the shaft 90 to facilitate insertion of the latch 62 into the base 66. If the base 66 is molded from a plastic material, this insertion is also facilitated by the resilience of the base walls. In this manner latches are easily inserted into the base 66 either during original assembly of the socket 60 or during later repair (e.g. when the socket 60 is mounted in an electronic assembly and a broken latch needs to be replaced).

FIGS. 8 and 9 also illustrate a groove 126 defined in the side of the base 66 that receives the knob 96 to maintain the latch 62 in the closed position of FIG. 62 when the SIMM 22 is not present. This allows the SIMM 22 to be inserted into the socket without having to manually hold the latches inboard.

Another preferred latch embodiment 140 is illustrated in FIGS. 14A-14D which are, respectively, side elevation, front elevation, side elevation and rear elevation views. The latch 140 differs from the latch 64 of FIGS. 10A-10D in that the side 142 has a reduced portion and also defines a gap 144 to create a flap 146 which bears the boss 74'. The addition of an ear to the latch 140, similar to the ear 110 shown in FIG. 13A, creates a polarized version of this embodiment similar to the latch 62 of FIGS. 13A, 13C.

Figure 3:
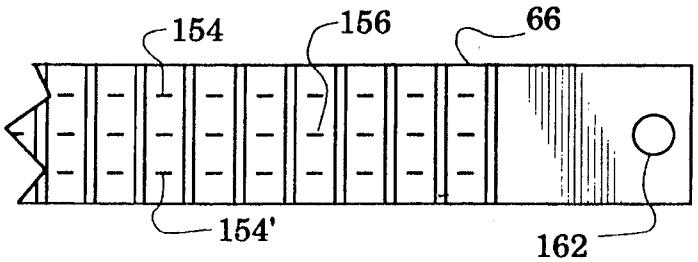
FIG. 3 is a partial bottom plan view of the socket of FIG. 2.
Figures 5A, 5B, 5C:
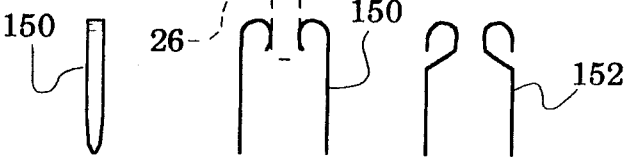
FIG. 5A is a side elevation view of a single contact pin embodiment for the socket of FIG. 2.
FIG. 5B is a front elevation view of the contact pin of FIG. 4A.
FIG. 5C is a front elevation view of another single contact pin embodiment for the socket of FIG. 2.
Figures 4A, 4B, 4C:
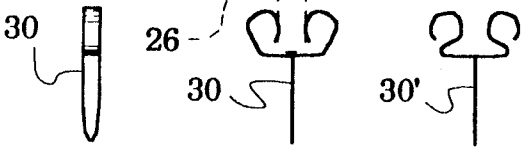
FIG. 4A is a side elevation view of a double contact pin embodiment for the socket of FIG. 2.
FIG. 4B is a front elevation view of the pin of FIG. 4A.
FIG. 4C is a front elevation view of another double contact pin embodiment for the socket of FIG. 2.

FIGS. 4A and 4B are side elevation and front elevation views of the contact pin 30 (shown also in FIGS. 1E, 1F). Another preferred embodiment 30' of this type of double pin is shown in FIG. 4C. FIGS. 5A-5C are similar views illustrating two embodiments 150, 152 of single pins which are intended to be used in pairs to replace the double pins of FIGS. 4A-4C. In FIG. 3 which is a partial bottom plan view of the socket 60 it is seen that three rows 154, 156 and 154' of contact holes are provided for. The typical SIMM referred to above, which has 9 logic chips, has contacts 32 (as shown in FIG. 2) designed to be contacted in pairs by contact pins such as 30 and 30'. For this SIMM configuration the contact pins 30 or 30' would be installed in the center row 156 of holes of the socket 60. A high density SIMM may be configured to have its contacts 32 electrically connected to separate points in a computer. For this SIMM configuration, pairs of the single pins 150 or 152 would be installed in the rows 154, 154' of holes.

FIGS. 2 and 3 also illustrate that the socket 60 defines a post 160 and a larger diameter post 162 which facilitate orientation of the socket 60 in a receiving structure.

Thus it should be apparent that ejecting socket embodiments have been disclosed herein for acceptance of and rejection of a SIMM. Embodiments in accordance with the invention may be economically molded from various plastic materials. The embodiments depicted herein are exemplary and numerous modifications and rearrangements can be made with the equivalent result still embraced within the scope of the invention.

What is claimed is:

1. An ejecting SIMM socket, comprising:

an elongated base defining a slot configured to receive the contact edge of a SIMM; and a pair of latches, each of said latches rotatably mounted in said base and defining a slot configured to receive one of the opposite corners of the contact edge of said SIMM, said latch slot terminating in a floor to abut said SIMM contact edge for ejecting said SIMM from said base when said latches are rotated.

2. A socket as defined in claim 1 wherein each of said latches defines a resilient flap and a boss disposed on said flap; said resilient flap allowing said boss to be received in one of the holes located on opposite sides of said SIMM to enhance retention of said SIMM in said socket.

3. A socket as defined in claim 1 wherein one of said latches defines, within said latch slot, an ear configured to be received within the notch in one side edge of said SIMM whereby said SIMM is appropriately oriented in said socket.

4. A socket as defined in claim 1 wherein each of said latches defines a serrated surface to facilitate gripping thereof for rotation of each of said latches.

5. A socket as defined in claim 1 wherein said base defines a first descending post and a second descending post greater in diameter than said first post, said first post and said second post thereby facilitating appropriate orientation in a mount receiving said socket.

6. A socket as defined in claim 1 wherein each of said latches defines a lip and said base defines an edge to abut said lip thereby defining an open position of each of said latches.

7. A socket as defined in claim 1 wherein each of said latches defines a tongue and said base defines an opening to receive said tongue when each of said latches is in said closed position.

8. A socket as defined in claim 1 further comprising a plurality of contact pins disposed in said base along said base slot for electrical connection to the contacts of said SIMM.

9. A socket as defined in claim 8 wherein said plurality of contact pins comprises double pins, each of said double pins configured to abut a pair of said SIMM contacts for electrical connection thereto, said pair of contacts located on opposite sides of said SIMM.

10. A socket as defined in claim 8 wherein said plurality of contact pins comprises a plurality of single pins, each of said single pins configured to abut one of said SIMM contacts for electrical connection thereto.

11. A socket as defined in claim 1 wherein each of said latches defines a shaft and said base defines a hole for rotatable reception of said shaft.

12. A socket as defined in claim 11 wherein said shaft defines a bevel and said base defines a ramp to receive said bevel to facilitate insertion of said shaft into said hole.

13. A socket as defined in claim 1 wherein each of said latches defines a step and said base defines a margin to abut said step thereby defining a closed position of each of said latches.

14. A socket as defined in claim 13 wherein each of said latches defines a knob and said base defines a groove to receive said knob to facilitate retention of each of said latches in said closed position.

15. An ejecting circuit board socket, comprising: an elongated base defining a slot configured to receive the contact edge of a circuit board; and a pair of latches, each of said latches rotatably mounted in said base and defining a slot configured to receive one of the opposite corners of the contact edge of said circuit board, said latch slot terminating in a floor to abut said circuit board contact edge for ejecting said circuit board from said base when said latches are rotated.

16. A socket as defined in claim 15 wherein each of said latches defines a resilient flap and a boss disposed on said flap; said resilient flap allowing said boss to be received in a hole located on a side of said circuit board to enhance retention of said circuit board in said socket.

17. A socket as defined in claim 15 wherein one of said latches defines, within said latch slot, an ear configured to be received within a notch in a side edge of said circuit board whereby said circuit board is appropriately oriented in said socket.

18. A socket as defined in claim 15 wherein each of said latches defines a shaft and said base defines a hole for rotatable reception of said shaft.

19. A socket as defined in claim 15 wherein:

each of said latches defines a lip and said base defines an edge to abut said lip thereby defining an open position of each of said latches;

each of said latches defines a step and said base defines a margin to abut said step thereby defining a closed position of each of said latches; and each of said latches defines a knob and said base defines a groove to receive said knob to facilitate retention of each of said latches in said closed position.

20. A method of ejecting a SIMM from a socket, comprising the steps of:

disposing said SIMM in a base of said socket wherein said base has a latch rotatably mounted thereon;

receiving a corner of the contact edge of said SIMM in a slot defined in said latch; and rotating said latch to eject said SIMM.

* * * * *